United States Patent [19]

Schoonderbeek

[11] Patent Number: 4,792,103

[45] Date of Patent: Dec. 20, 1988

[54] DEVICE FOR SPLICING TWO WEBS OF MATERIAL EACH ORIGINATING FROM A ROLL

[75] Inventor: Hubertus J. Schoonderbeek, KK Beuningen, Netherlands

[73] Assignee: Stork Brabant B.V., An Boxmeer, Netherlands

[21] Appl. No.: 12,030

[22] Filed: Feb. 9, 1987

[30] Foreign Application Priority Data

Feb. 11, 1986 [NL] Netherlands ..... 8600336

[51] Int. Cl.[4] ..... B65H 19/14; B65H 16/06

[52] U.S. Cl. ..... 242/58.1; 242/75.1; 242/75.41

[58] Field of Search ..... 242/58.1, 58.2, 58.3, 242/58.4, 68.4, 75.41, 75.1, 58

[56] References Cited

U.S. PATENT DOCUMENTS

| | | | |
|---|---|---|---|
| 1,672,320 | 6/1928 | James | 242/75.41 |
| 2,095,019 | 10/1937 | Wood | 242/68.4 |
| 3,740,296 | 6/1973 | McDonald | 242/58.1 X |
| 3,863,854 | 2/1975 | Tokuno | 242/58.2 |
| 4,233,104 | 11/1980 | Fujishima et al. | 242/58.1 X |
| 4,544,109 | 10/1985 | Andreasson | 242/58.1 |

FOREIGN PATENT DOCUMENTS 3311746 10/1984 Fed. Rep. of Germany .

*Primary Examiner*—John M. Jillions

*Attorney, Agent, or Firm*—Watson, Cole, Grindle & Watson

[57] ABSTRACT

A device for splicing the trailing (downstream) end of a first web of material (the expiring web) originating from a first roll to a leading (upstream) end of a second web of material (the new web) originating from a second roll, during stoppage, comprises a frame which accommodates at least a festoon, a web splicing unit and two roll holders. Each roll holder comprises two arms which are fitted so as to be slideable in the axial direction and non-rotatable on a pivot shaft mounted horizontally in the frame and coupled to a rotating mechanism.

Each roll holder further comprises two chucks rotatably mounted in the ends of the arms and situated opposite each other coaxially for receiving a roll between them. A vertically arranged drive belt unit is situated between the arms of each roll holder for rotationally driving a roll received between the two chucks. With the roll holder a roll can be easily picked up and pressed against a drive belt.

5 Claims, 5 Drawing Sheets

DEVICE FOR SPLICING TWO WEBS OF MATERIAL EACH ORIGINATING FROM A ROLL

BACKGROUND OF THE INVENTION

The present invention relates to a device for splicing the trailing (downstream) end of a first web of material (the expiring web) originating from a first roll to the leading (upstream) end of a second web of material (the new web) originating from a second roll, during stoppage, comprising a frame which accommodates at least a festoon, a web splicing unit and two roll holders having horizontal axes, each roll holder comprising two rotatable chucks for receiving a roll, which chucks are situated opposite each other coaxially and at least one being movable in the horizontal direction and at least one vertically arranged drive belt unit situated between the two chucks for each roll holder, for rotationally driving a roll received between the chucks.

A device of this type is known, for example, from German Patent Specification No. 3.311.746 and can be used in printing machines. Splicing of the two material webs during stoppage has, inter alia, the advantage that a very good splice can be made. In the known device the chucks are rotatably mounted in two opposite side walls of a roll support frame. One chuck of a pair of chucks of a roll holder is axially displaceable by means of a cylinder-piston unit, so as to enable the receipt of a roll between a pair of chucks. The other chuck of the pair of chucks is coupled with a braking device to decelerate a roll received between the pair of chucks. Furthermore, means are provided for pressing a section of the drive belt of the drive belt unit against a section of the circumference of the roll received between a pair of chucks.

However, the known device has a number of drawbacks. It is rather difficult to place a roll between the chucks of a roll holder, thus necessitating the use of a crane or other lifting device. Furthermore, the device is suitable for rolls with only one width. Finally, the whole drive belt unit must be tiltable so as to be able to press the drive belt against the roll.

SUMMARY OF THE INVENTION

The object of the present invention is, therefore, to provide a device for splicing two webs of material, each originating from a roll, which does not have the above-mentioned drawbacks and which offers the possibility of making use of simple transport means, both for placing and removing the rolls.

This object is achieved according to the invention by a device of the above-mentioned type wherein the chucks of each roll holder are rotatably mounted in the ends of two arms which are tiltable about a horizontal axis and movable in the horizontal direction.

As a result of this, the chucks can be be brought to the desired height above the ground in order to be able to receive a roll presented on, for example, a hand truck. By moving the carrying arms towards each other, the chucks are inserted in the ends of the central cylindrical sleeve of the roll and then clamped therein by expansion. Furthermore, it offers the possibility to make the drive belt unit stationary and to press the roll against the drive belt by tilting the arms of the roll holder, so that the roll holder has two functions, viz. picking up the roll and pressing the roll against the drive belt.

Expediently the arms are fitted so as to be slidable in the axial direction and non-rotatable on a pivot shaft, horizontally mounted in the frame and coupled to a rotating mechanism which may consist of a lever rigidly attached to the pivot shaft and a linear actuating device fitted between the end of the lever and the frame.

The displacement of the arms along the pivot shaft may take place by means of a rack mounted in the longitudinal direction on the pivot shaft.

The drive belt unit consists preferably of a yoke which is formed from two essentially C-shaped plate parts situated essentially in parallel at some distance from each other and rigidly connected to each other, a drive roller and several guide rollers which are fitted in parallel to each other between the C-shaped plate parts and a drive belt running round the rollers.

Expediently a guide roller fitted in the lower part of the C-shaped yoke is designed as a tensioning roller, which is fitted displaceably in the lower part of the C-shaped yoke and the drive roller of the drive belt unit is mounted on a drive shaft, extending parallel to the pivot shaft and coupled to a motor generator unit.

In an advantageous embodiment of the device of the invention each chuck is mounted co-axially and non-rotatably on a pulley which is rotatably supported in the end of the associated arm of the roll holder and which can cooperate with an auxilliary drive belt unit, which may consist of an arm pivotable about a horizontal axis at one end and provided with a drive roller and a guide roller having axes parallel to the pivot axis of the arm and a drive belt running around the rollers, the auxilliary drive belt unit being driven by the same electrical motor generator unit as the associated main drive belt unit.

With this construction it is possible to drive the roll via one or both chucks of the roll holder instead of by the main drive belt unit, which is important if the diameter of the roll is small and its stiffness low.

The invention will now be explained in the description below of an exemplary embodiment on the basis of the drawings.

DETAIILED DESCRIPTION OF THE PREFERRED EMBODIMENTS

Figure 1:
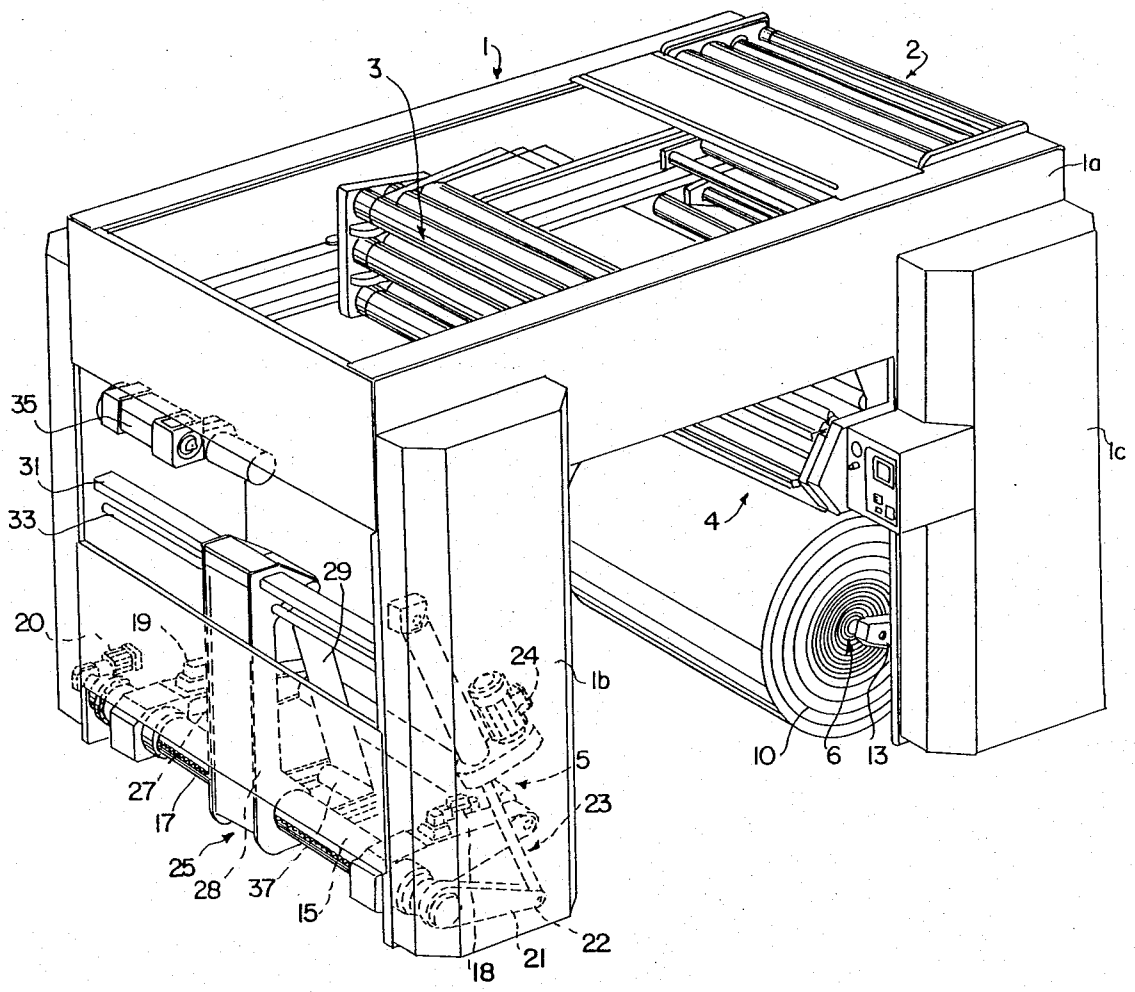
FIG. 1 is a perspective view of a first embodiment of the device according to the invention.
Figure 2:
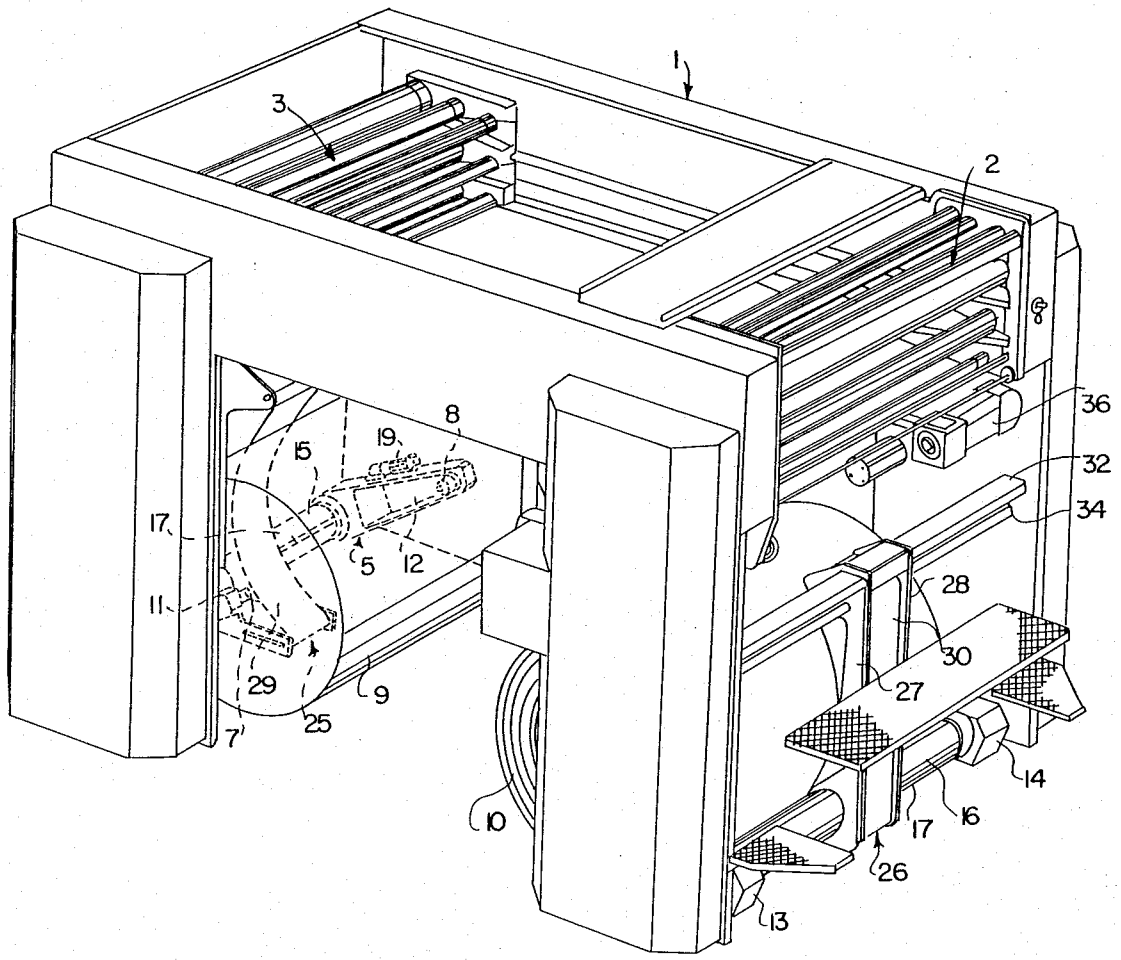
FIG. 2 is a perspective view of the device of FIG.1 from the other side.

The embodiment of a device according to the invention shown in FIGS. 1 and 2 comprises a frame 1 which includes an upper horizontal frame part 1*a* and two downwardly-extending verticle frame parts 1*b* and 1*c*, a festoon consisting of a fixed roller assembly 2 and a moveable dancer roller assembly 3, a web joining unit 4 and two roll holders 5, 6.

Each roll holder 5, 6 comprises two rotatable chucks 7, 8, situated coaxially opposite each other for receiving a roll 9 or 10, respectively, of a web of material. The chucks 7, 8 are rotatably mounted in the ends of two arms 11, 12 or 13, 14, respectively, which can be tilted about a horizontal axis and can be displaced in the horizontal direction, the arms 11, 12; 13, 14 of each of the two roll holders 5,6 being fitted so as to be slideable in axial direction and non-rotatable, on a pivot shaft 15, 16 mounted horizontally in the frame. The arms 11, 12; 13, 14 can be displaced along the pivot shaft 15; 16 by means of racks 17 fitted in the longitudinal direction on the pivot shaft 15; 16, the electric motors 18 and 19 on the arms providing the drive. An electric motor 20 serves to displace the roll holder 5; 6 in its entirety laterally for the purpose of lateral corrections.

To receive the roll in, for example, the roll holder 5, the arms 11, 12 are moved apart by means of the motors 18, 19 and a roll presented by a simple transport means such as a hand truck is placed between the arms, care being taken to ensure that the chucks 7, 8 are sited opposite the central cylindrical sleeve of the roll 9. The arms 11, 12 are then moved towards each other and the chucks 7, 8 are inserted into the ends of the cylindrical sleeve of the roll and are subsequently clamped therein by expanding them. In order to be able to tilt the arms 11, 12; 13, 14 of the two roll holders 5, 6, the pivot shafts 15, 16 are each coupled to a rotating mechanism which, in the embodiment shown, consists of a lever 21 rigidly attached to the pivot shaft 15; 16, and a spindle structure 23 fitted between the end 22 of the lever 21 and the frame 1 and which can be driven by an electric motor 24. Since the arms 11, 12; 13, 14 are unrotatably connected to the associated pivot shaft 15; 16, operation of the spindle structure 23, which causes the lever 21 to tilt, will cause the arms of the roll holder 5; 6 concerned to tilt about the axis of the pivot shaft 15; 16. In this manner, a roll received in the roll holder can be moved up and down in the vertical direction.

A drive belt unit 25 or 26, respectively, is situated near each roll holder between the two arms 11, 12 or 13, 14, respectively, for driving a roll 9 or 10, respectively, received in the roll holder. Each drive belt unit 25; 26 consists of a yoke which is formed from two essentially C-shaped plate parts 27, 28 which are situated essentially in parallel at some distance from each other and are rigidly connected to each other. A drive roller and several guide rollers, which are parallel to each other, are fitted between the C-shaped plate parts. A drive belt 29; 30 for driving the roll 9; 10 runs round the rollers, which drive belt can be pressed partially against a section of the circumference of the roll 9; 10.

Each drive belt unit 25; 26 is secured in the frame 1 by the pivot shaft 15; 16 of the associated roll holder 5; 6 and a guide bar 31; 32 which extends above it parallel to the pivot shaft and is received in the frame 1. At the same time the pivot shafts 15, 16 and the guide bars 31, 32 project through the suitable cutouts made in the C-shaped plate parts 27, 28.

The drive roller of each drive belt unit 25; 26 is mounted on a drive shaft 33; 34, extending parallel to the pivot shaft 15; 16 and mounted in the frame 1, which drive shaft is coupled to an electric motor generator unit 35; 36 fitted on the frame. As a result, the drive belt unit can also be used for braking an expiring feed-roll. The motor generator units 35, 36 further serve to maintain the dancer function of the festoon. A guide roller 37 fitted in the bottom leg of the C-shaped yoke of each drive belt unit is designed as a tensioning roller. For this purpose, the guide roller 37 is displaceable mounted in the bottom leg of the yoke.

A roll received in a roll holder can be pressed against the drive belt by tilting the arms of the roll holder towards the drive belt.

Figure 3:
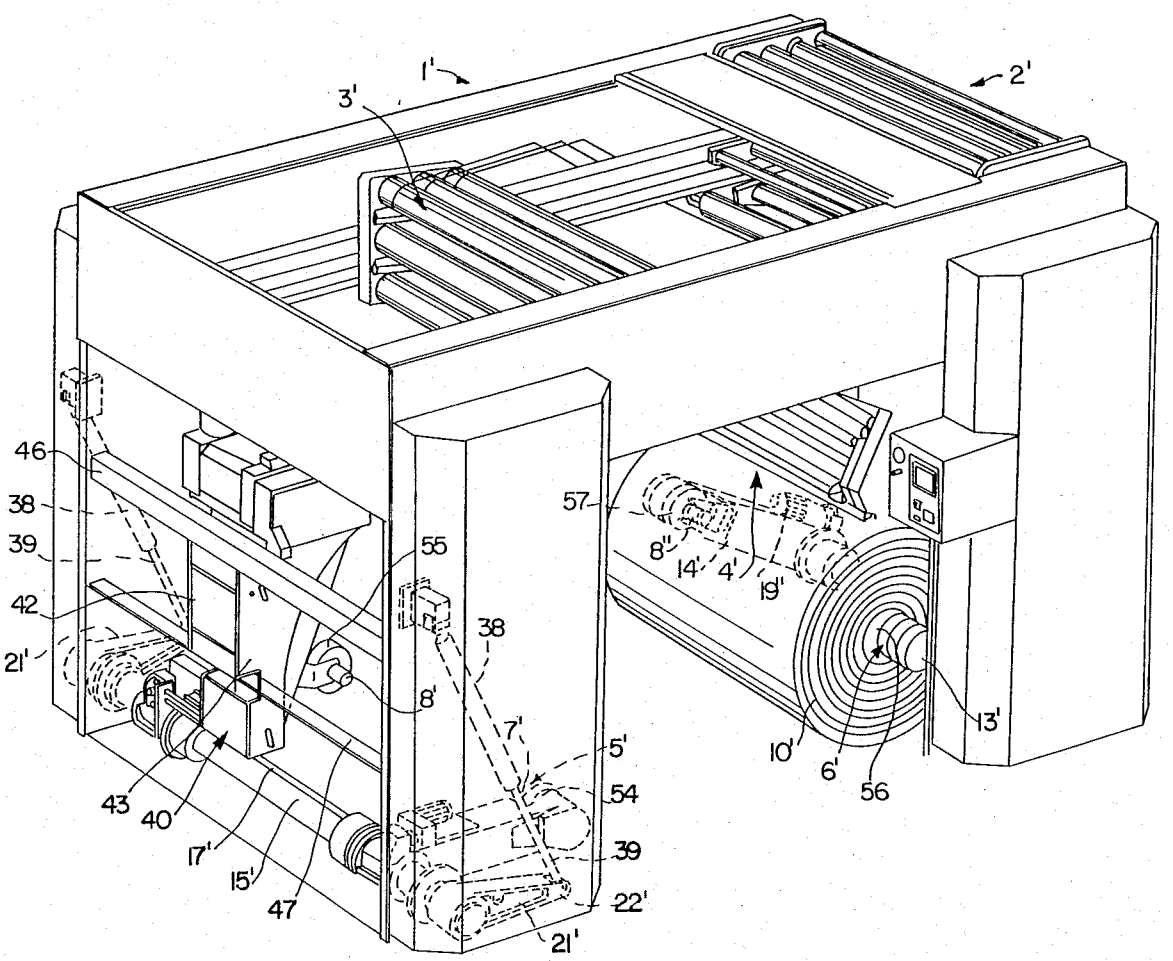
FIG. 3 is a perspective view similar to FIG. 1 of another embodiment of the device according to the invention.
Figure 4:
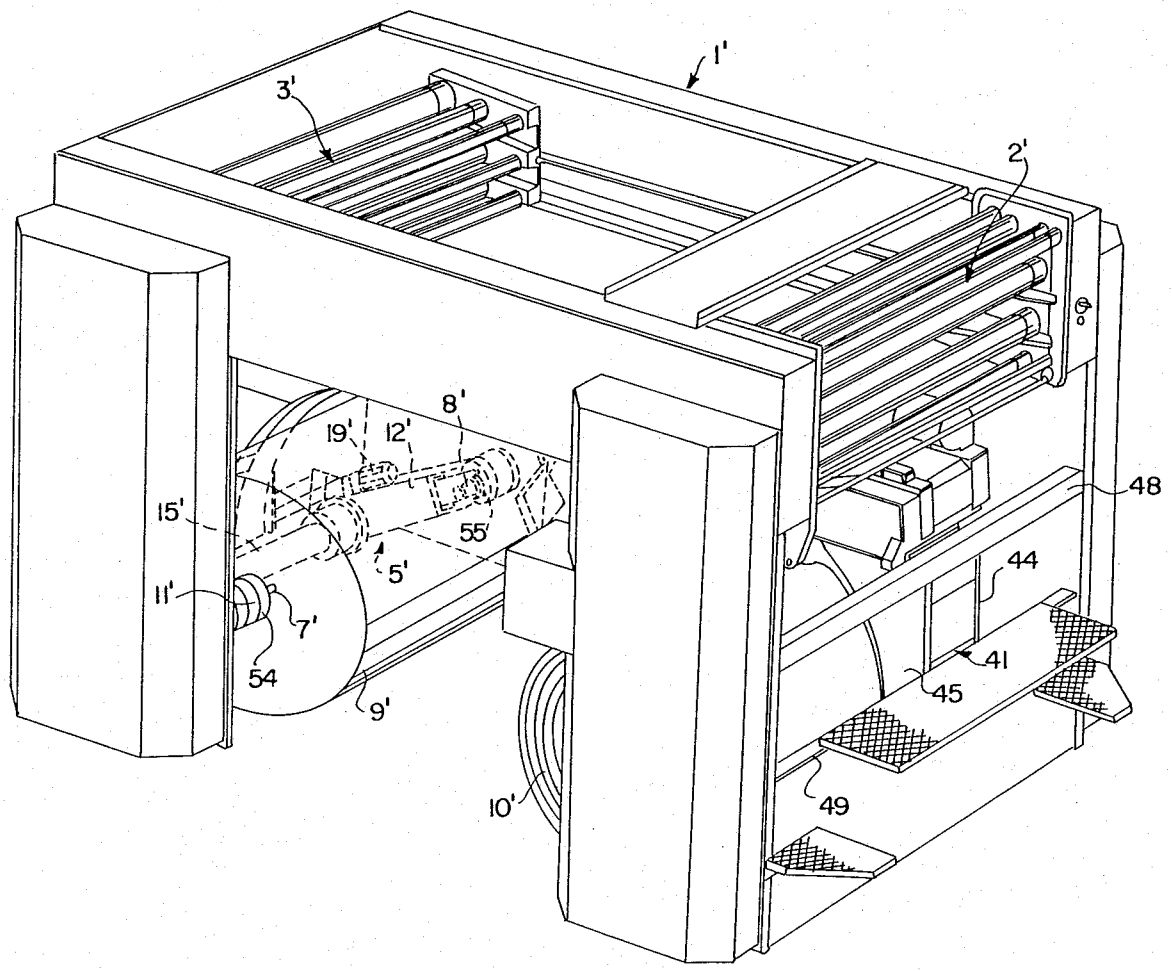
FIG. 4 is a perspective view of the device of FIG. 3 from the other side.

The structure of the embodiment of the device shown in FIGS. 3 and 4 is in general similar to that of the device shown in FIGS. 1 and 2.

In FIGS. 3 and 4 similar parts are indicated by the same reference numerals, with an accent. These parts will not be described again with reference to FIGS. 3 and 4. Only different parts will be described below.

In the embodiment of FIGS. 3 and 4 the lever 21' rigidly attached to the pivot shaft 15' is actuated by means of a cylinder 38 and a piston rod 39 fitted between the end 22' of the lever 21' and the frame 1'. The pivot shaft 15' can be provided with a rotating mechanism at both sides, as is shown in FIG. 3.

Each drive belt unit 40; 41 comprises a yoke formed from two essentially C-shaped plate parts 42, 43 and 44, 45, respectively, having a shape which is different from that of the plate parts 27, 28 of the embodiment of FIGS. 1 and 2.

Figure 5:
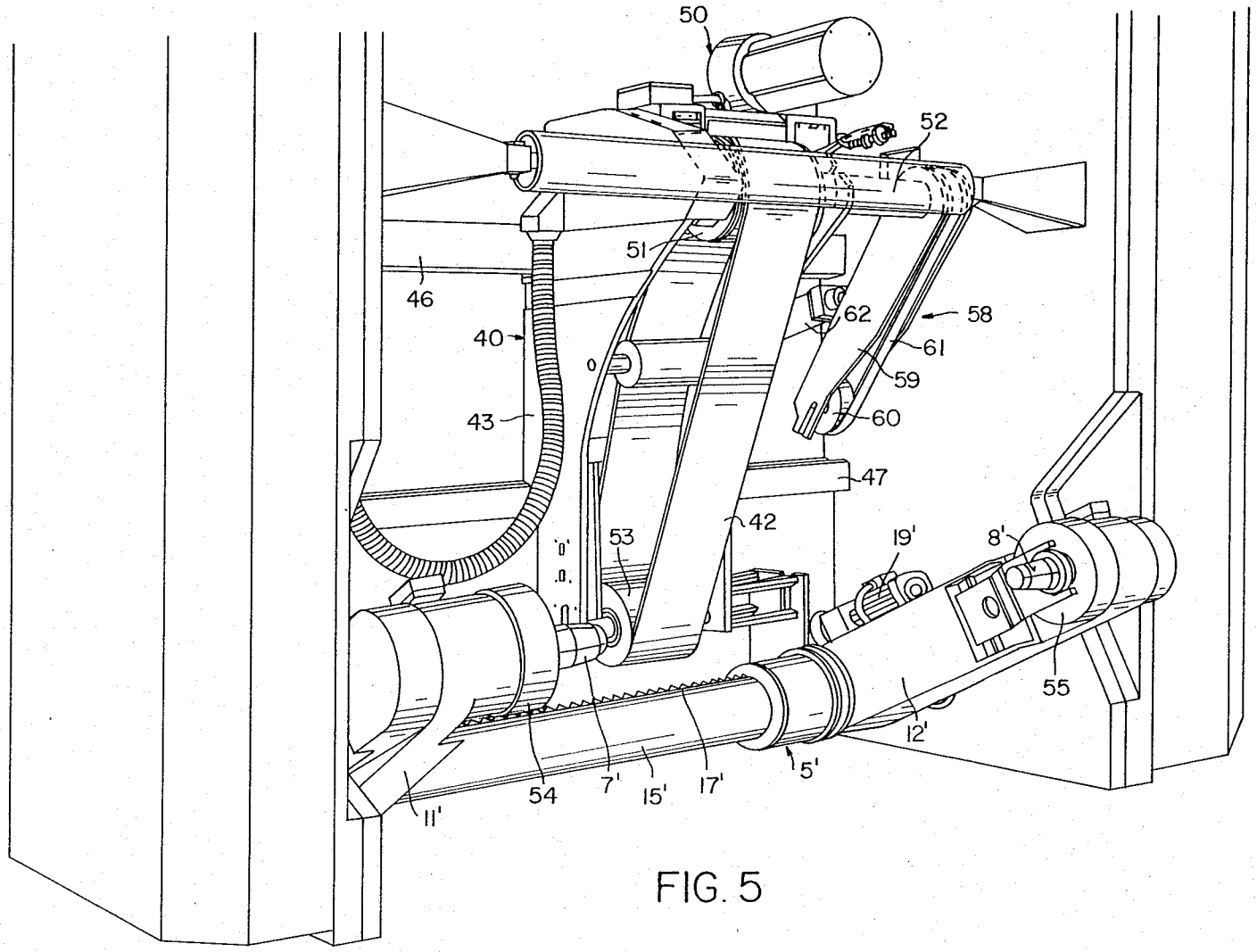
FIG. 5 is a perspective view on enlarged scale of a roll holder with drive belt units of the device of FIG. 3.

The drive belt units 40 and 41 are guided in the frame 1' by means of transverse guide bars 46, 47 and 48, 49, respectively, which extend parallel to the shaft 15' and which are received in the frame 1'. As is shown in FIG. 5' the electric motor generator unit 50 for driving the driven belt is mounted on top of the drive belt unit 40 and coupled with the drive roller 51 via the drive shaft 52. A guide roller 53 fitted in the lower part of the C-shaped yoke is vertically displaceable in the yoke and serves as a tensioning roller.

In the embodiment of FIGS. 3 to 5 each chuck 7', 8', 7'', 8'' is mounted coaxially and non-rotatably on a pulley 54, 55, 56, 57. The pulleys are rotatably supported in the ends of the arms 11', 12', 13', 14' of the two roll holders 5', 6'. Each pulley can cooperate with an auxiliary drive belt unit. One of the auxilliary drive belt units 58 is shown in FIG. 5. The auxilliary drive belt unit 58 consists of an arm 59 which is pivotable at one end about a horizontal axis, in this case the drive shaft 52 of the main drive belt unit 40. The arm 59 is provided with a drive roller (not shown) and a guide roller 60, having axes parallel to the pivot axis of the arm 59.

A drive belt 61 is running around these rollers. The drive pulley is mounted on the drive shaft 52 of the main drive belt unit and therefore driven by the same electric motor generator unit 50 as the drive roller 51 of the main drive belt unit.

When during unrolling the diameter of a roll received in the roll holder 5' and pressed against the drive belt 42 by means of the arms 11', 12' decreases to a certain value the circumferential force on the roll exerted by the drive belt 42 will no longer be sufficient to provide the torque necessary to overcome the frictional forces exerted on the rotating roll (radius of the roll has become too small). Increasing the pressing force between the drive belt 42 and the roll will in most cases not be possible as the stiffness of the roll has decreased strongly, so that the roll would be bent too much.

At that moment the roll is lifted from the drive belt 42 of the main drive belt unit 40 and the drive belt 61 of the auxilliary drive belt unit 58 is brought into contact with the pulley 55 by swinging the arm 59 by means of the cylinder 62. The roll is then driven via the chuck 8'.

The operation mode of the electric motor 50 is changed from constant speed to variable speed.

It will be clear that it is also possible to drive the pulley 54 with the chuck 7' by means of another auxilliary drive belt unit.

The auxilliary drive belt unit or units can also be used for braking a roll received in the roll holder 5'.

Auxilliary drive belt units may also be mounted at the other side of the device to cooperate with the pulleys 56, 57 of the roll holder 6'.

The invention is not limited to the embodiments of the device described above. Thus, other designs of the roll holder and the drive belt unit are possible within the scope of the invention.

What is claimed is:

1. An apparatus for splicing and feeding a web of material comprising a supporting frame which includes a horizontal upper frame part and two downwardly-extending vertical frame parts, two web roll holding units, each web roll holding unit comprising a horizontal pivot shaft rotatably mounted in one of said vertical frame parts and two arms non-rotatably and slidably mounted on the pivot shaft for horizontal displacement along the pivot shaft, each arm having a free end that includes a rotatably mounted chuck for supporting, together with the chuck on the other arm of the roll holding unit, a web roll, drive means for pivoting each said pivot shaft, two drive belt units, each drive belt unit being mounted stationarily in a vertical plane between the two arms of a web roll holding unit and each drive belt unit comprising a main drive belt arranged to as to cooperate with a portion of the outer circumference of a web roll for rotationally driving the web roll, drive means for each main drive belt, a web splicing unit for connecting the trailing end of the web of one of the web rolls to the leading end of the web of the other web roll when both said trailing end and said leading end are stationary, and web accumulating means accommodated in the horizontal upper frame part for accumulating the web supplied from the web splicing unit and for feeding the web therefrom to web working means located downstream of the web accumulating means.

2. The apparatus according to claim 1, wherein the drive means for pivoting each of the pivot shafts consists of at least one lever rigidly attached to the pivot shaft and a linear actuating device fitted between the end of the lever and the supporting frame.

3. The apparatus according to claim 1, wherein each drive belt unit consists of a yoke which is formed from two spaced apart, essentially C-shaped plate parts situated essentially in parallel and rigidly connected to each other, a drive roller and several guide rollers which are mounted in parallel between the C-shaped plate parts, and a main drive belt running around the rollers, one of the guide rollers being fitted displaceably in the lower part of the C-shaped yoke as as to act as a tensioning roller for the main drive belt.

4. The apparatus according to claim 1, wherein each chuck is mounted coaxially and non-rotatably on a pulley which is rotatably supported in the free end part of the respective arm of the respective web roll holding unit and wherein each drive belt unit further comprises at least one auxiliary drive belt unit comprising an arm pivotably about a horizontal axis at one end and provided with a drive roller and a guide roller having axes parallel to the pivot axis of the arm and an auxiliary drive belt running around the rollers, the auxiliary drive belt unit being connected to the drive means for the main drive belt of the drive belt unit and being provided with pivoting means such that the auxiliary drive belt can be brought into driving contact with a pulley on which a chuck is mounted.

5. The apparatus according to claim 4, wherein the drive means for the main and auxiliary drive belts of a drive belt unit comprises an electrical motor generator unit operable in a constant or a variable speed mode.

* * * * *